US008172357B2

(12) United States Patent
Enomoto

(10) Patent No.: US 8,172,357 B2
(45) Date of Patent: May 8, 2012

(54) PRINT POSITION CORRECTING DEVICE, METHOD OF CONTROLLING PRINT POSITION CORRECTING DEVICE, AND PRINTING APPARATUS

(75) Inventor: Katsumi Enomoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 384 days.

(21) Appl. No.: 12/621,716

(22) Filed: Nov. 19, 2009

(65) Prior Publication Data

US 2010/0149248 A1 Jun. 17, 2010

(30) Foreign Application Priority Data

Dec. 15, 2008 (JP) ..... 2008-318013

(51) Int. Cl.
*B41J 29/38* (2006.01)
*B41J 29/393* (2006.01)

(52) U.S. Cl. ..... 347/19; 347/5; 347/16

(58) Field of Classification Search ..... 347/5, 16, 347/19–20
See application file for complete search history.

(56) References Cited

U.S. PATENT DOCUMENTS 5,973,717 A * 10/1999 Kerr et al. ..... 347/234
2008/0259110 A1* 10/2008 Korem et al. ..... 347/16

FOREIGN PATENT DOCUMENTS

JP 08-230194 9/1996
JP 2008-012712 1/2008

* cited by examiner

*Primary Examiner* — Jason Uhlenhake
(74) *Attorney, Agent, or Firm* — Workman Nydegger

(57) ABSTRACT

A print position correcting device includes: a head unit which ejects a liquid onto a print medium being transported on a transport surface; detectors which detect a position of the print medium being transported; a transport information calculator which calculates transport information regarding a transport status of the print medium based on the position of the detected print medium; a movement speed calculator which calculates a movement speed used to move the head unit based on the transport information; and a controller which moves the head unit in a direction parallel to the transport surface based on the transport information and the movement speed.

9 Claims, 11 Drawing Sheets

FIG. 8A1
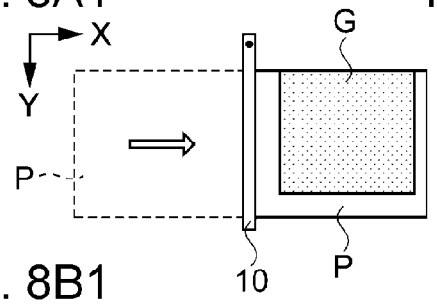
FIG. 8A2
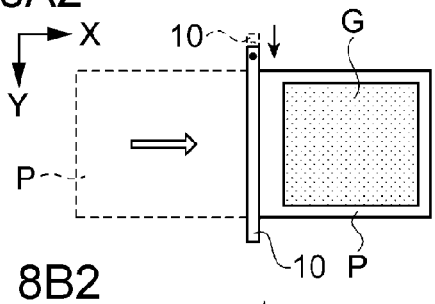
FIG. 8B1
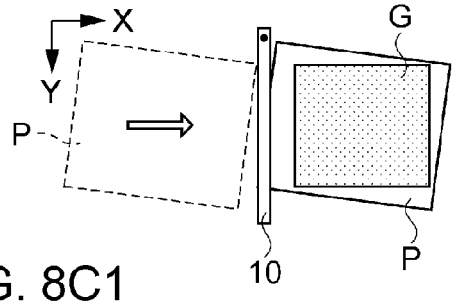
FIG. 8B2
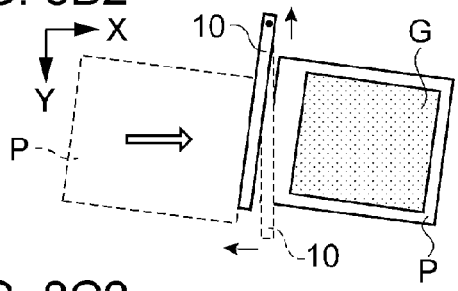
FIG. 8C1
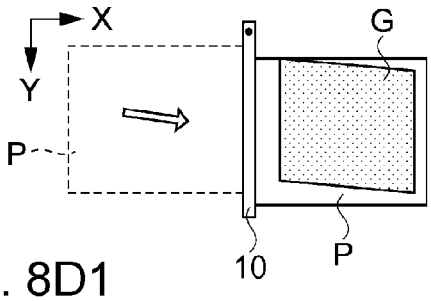
FIG. 8C2
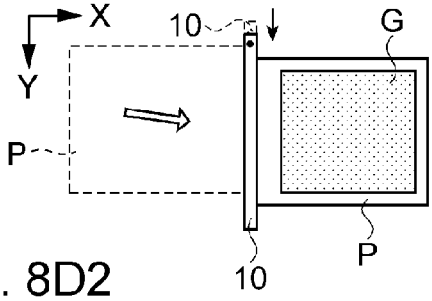
FIG. 8D1
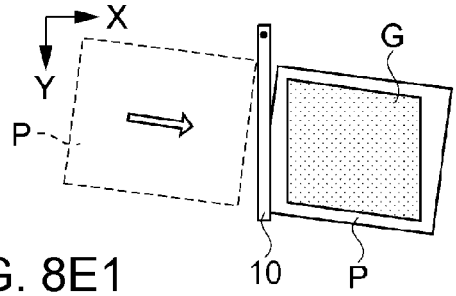
FIG. 8D2
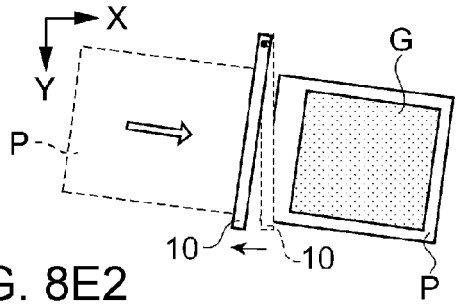
FIG. 8E1
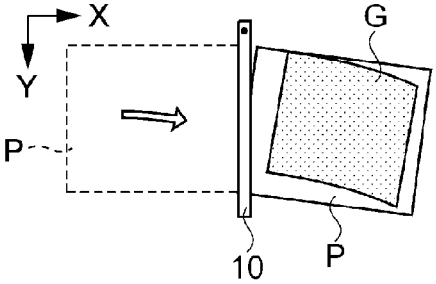
FIG. 8E2
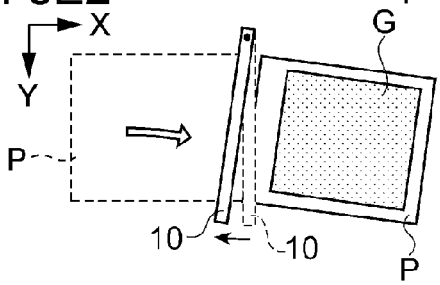

PRINT POSITION CORRECTING DEVICE, METHOD OF CONTROLLING PRINT POSITION CORRECTING DEVICE, AND PRINTING APPARATUS

BACKGROUND

1. Technical Field

The present invention relates to a print position correcting device, a method of controlling the print position correcting apparatus, and a printing apparatus.

2. Related Art

In the past, there have been suggested various techniques for ejecting a liquid from a head unit onto exact positions on a print medium being transported in a printing apparatus such as an ink jet printer. For example, in an ink jet printer disclosed in JP-A-8-230194, ejection timing is corrected by detecting the transport speed of a print medium in order to land liquid droplets onto the exact positions on the print medium of which the transport speed is not uniform. In addition, in an ink jet printer disclosed in JP-A-2008-12712, the alignment of a line head is automatically adjusted with high precision to prevent a print defect such as an oblique line caused due to an alignment error of the line head.

In the ink printer disclosed in JP-A-8-230194, however, a change in the movement in a width direction of the print medium cannot be handled during printing. Moreover, when the print medium is obliquely transported in a transport direction or when the print medium is transported to a position deviated from the position to which the print medium was to be originally transported, such movement cannot be handled either. Accordingly, when the relative position of the head unit relative to the print medium is not uniform, an image cannot be formed in the intended region of the print medium. JP-A-2008-12712 discloses a method of aligning the line head of the ink jet printer. As in JP-A-8-230194, a change in the relative position of the head unit relative to the print medium cannot be handled during printing.

SUMMARY

An advantage of some aspects of the invention is that it provides a print position correcting device, a method of controlling the print position correcting apparatus, and a printing apparatus.

According to an aspect of the invention, there is provided a print position correcting device including: a head unit which ejects a liquid onto a print medium being transported on a transport surface; detectors which detect a position of the print medium being transported; a transport information calculator which calculates transport information regarding a transport status of the print medium based on the position of the detected print medium; a movement speed calculator which calculates a movement speed used to move the head unit based on the transport information; and a controller which moves the head unit in a direction parallel to the transport surface based on the transport information and the movement speed.

In the print position correcting device, the transport information calculator calculates the transport information regarding the transport status of the print medium based on the position of the print medium detected by the detectors. The movement speed calculator calculates the movement speed of the head unit based on the transport information. The controller moves the head unit in the direction parallel to the transport surface based on the transport information and the movement speed.

When the relative position of the head unit relative to the print medium being transported is not uniform, the head unit can be moved in accordance with the transport information to make the relative position uniform by moving the head unit based on the transport information of the print medium. At this time, since the head unit can be moved based on the movement speed of the head unit calculated from the transport information, the head unit can be smoothly moved. As a consequence, the head unit can form an image having no irregularity in the intended region of the print medium.

In the print position correcting device according to the above aspect of the invention, the transport information may contain a position deviation degree that the print medium is deviated from a predetermined reference position in a width direction of the print medium. The controller may move the head unit based on the position deviation degree.

According to the print position correcting device, the controller can move the head unit based on the position deviation degree in the width direction of the print medium, which is contained in the transport information. Accordingly, when the print medium is position-deviated, the position deviation of the sheet can be handled by moving the head unit.

In the print position correcting device according to the above aspect of the invention, the transport information may contain a position deviation speed indicating the position deviation degree per unit time. The movement speed calculator may calculate the movement speed used to move the head unit based on the position deviation speed.

According to the print position correcting device, the movement speed calculator calculates the movement speed used to move the head unit based on the position deviation speed of the print medium. Accordingly, when the position deviation of the print medium is changed with time, the head unit can smoothly move straight at the movement speed adjusted in accordance with the change in the position deviation. In this way, the relative position of the head unit relative to the print medium can be made uniform.

In the print position correcting device according to the above aspect of the invention, the transport information may contain an incline degree that the print medium is inclined. The controller may pivot the head unit on a shaft in a direction perpendicular to the transport surface based on the incline degree.

According to the print position correcting device, the controller can pivot the head unit on the shaft in the direction perpendicular to the transport surface based on the incline degree contained in the transport information. Accordingly, when the print medium is inclined, the inclination of the print medium can be handled by pivoting the head unit.

In the print position correcting device according to the above aspect of the invention, the transport information may contain an inclination speed indicating the incline degree per unit time. The movement speed calculator may calculate the movement speed used to pivot the head unit on the shaft in the direction perpendicular to the transport surface based on the inclination speed.

According to the print position correcting device, the movement speed calculator calculates the movement speed used to pivot the head unit on the shaft in the direction perpendicular to the transport surface based on the inclination speed of the print medium. Accordingly, when the inclination of the print medium is changed with time, the head unit can smoothly pivot at the movement speed adjusted in accordance with the change in the inclination. In this way, the relative position of the head unit relative to the print medium can be made uniform.

In the print position correcting device according to the above aspect of the invention, the detectors may be disposed on the upstream side and the downstream side of the head unit in a transport direction of the print medium.

According to the print position correcting device, based on the position of the print medium detected by the detectors on the upstream side and the downstream side, it is possible to discriminate cases where the print medium is transported onto the transport surface in the inclined state, cases where the print medium is transported obliquely in the transport direction, and cases where the print medium is transported to a position deviated from the position to which the print medium has to be originally transported, or the like, even while the front end or the rear end of the print medium is printed.

In the print position correcting device according to the above aspect of the invention, the head unit may include a plurality of ejecting heads. The movement speed calculator may calculate the movement speed used to move each of the plurality of ejecting heads based on the transport information. The controller may move the plurality of ejecting heads in the direction parallel to the transport surface based on the transport information and the movement speed.

According to the print position correcting device, it is possible to precisely move each of the ejecting heads based on the transport information by individually moving the plurality of ejecting heads based on the transport information. Accordingly, it is possible to form an image on the intended region of the print medium in accordance with various transport statuses of the print medium.

According to another aspect of the invention, there is provided a method of controlling a print position correcting device. The method includes: detecting a position of a print medium being transported on a transport surface; calculating transport information regarding a transport status of the print medium based on the position of the detected print medium; calculating a movement speed used to move the head unit based on the transport information; and moving the head unit in a direction parallel to the transport surface based on the transport information and the movement speed.

According to the method of controlling the print position correcting device, in the step of calculating the transport information, the transport information is calculated based on the position of the print medium detected in the detecting step. In addition, in the step of calculating the movement speed, the movement speed of the head unit is calculated based on the transport information. In the control step, the head unit is moved in the direction parallel to the transport surface based on the transport information and the movement speed.

In that the head unit can be moved based on the transport information of the print medium, the relative position of the head unit relative to the print medium being transported can be made uniform by moving the head unit based on the transport information, even when the relative position is not uniform. In this case, since the head unit can be moved based on the movement speed of the head unit calculated based on the transport information, it is possible to move the head unit smoothly. As a consequence, the head unit can form an image having no irregularity in the intended region of the print medium.

According to still another aspect of the invention, there is provided a printing apparatus including the print position correcting device according to the above aspect of the invention which performs printing on a print medium.

According to the printing apparatus, the relative position of the head unit relative to the print medium being transported can be made uniform by the print position correcting device, even when the relative position is not uniform. Accordingly, it is possible to form an image in the intended region of the print medium.

BRIEF DESCRIPTION OF THE DRAWINGS

The invention will be described with reference to the accompanying drawings, wherein like numbers reference like elements.

FIGS. 8A1-8E1 and 8A2-8E2 are a diagrams illustrating an example where each correction is performed or not on the head unit.

DESCRIPTION OF EXEMPLARY EMBODIMENTS

First Embodiment

Hereinafter, as an example of a printing apparatus including a print position correcting device and performing printing on a print medium, an ink jet printer according to a first embodiment which prints an image on a print medium such as a sheet by jetting (ejecting) a liquid such as ink will be described. Here, the ink jet printer is a line head type ink jet printer capable of performing printing by so-called one pass in that the ink jet printer includes two head units mounted with a plurality of ink jet heads (ejecting heads) in a direction intersecting a sheet transport direction.

Figure 1:
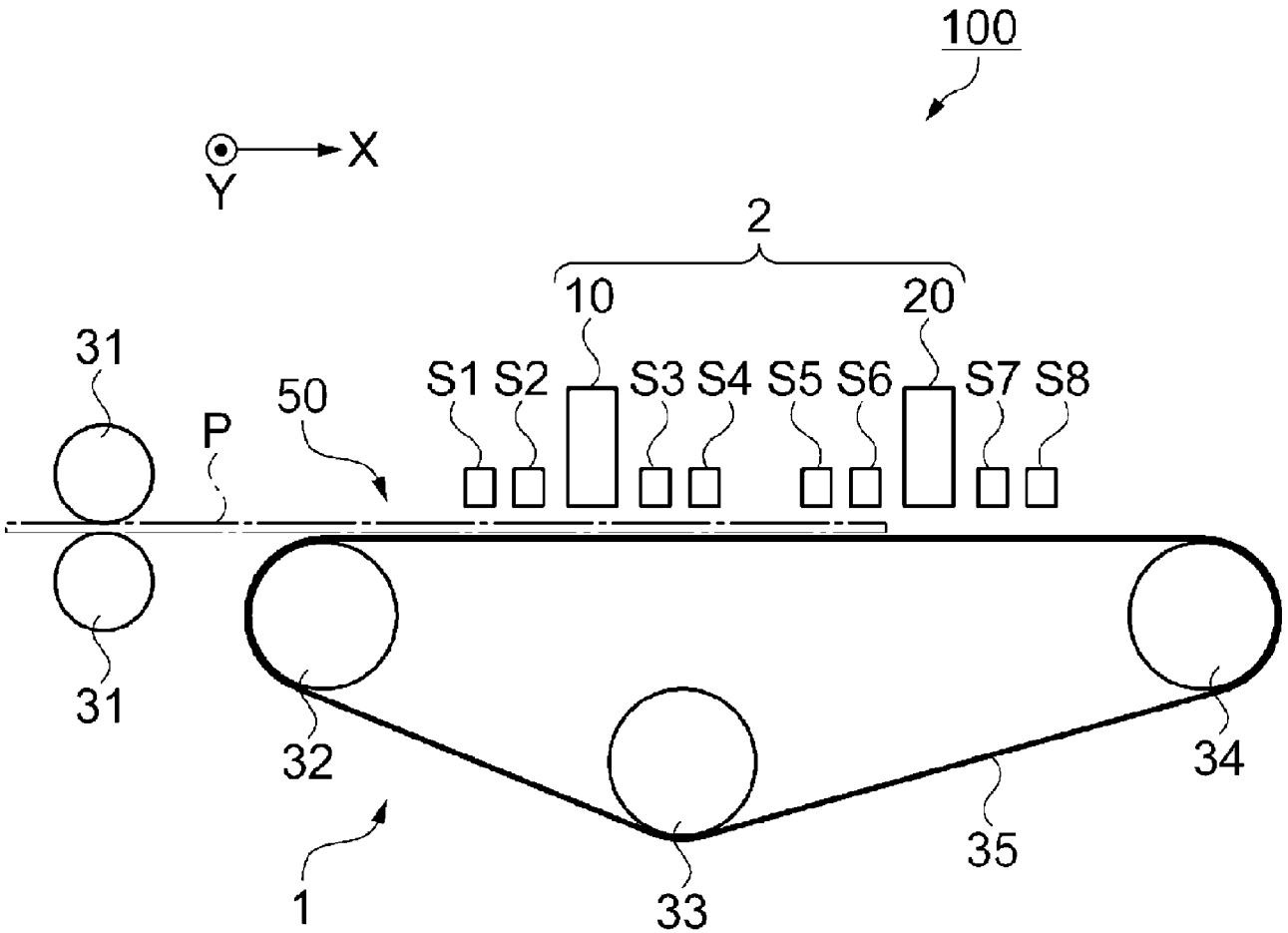
FIG. 1 is a side sectional view schematically illustrating the overall configuration of an ink jet printer according to a first embodiment.
Figure 2:
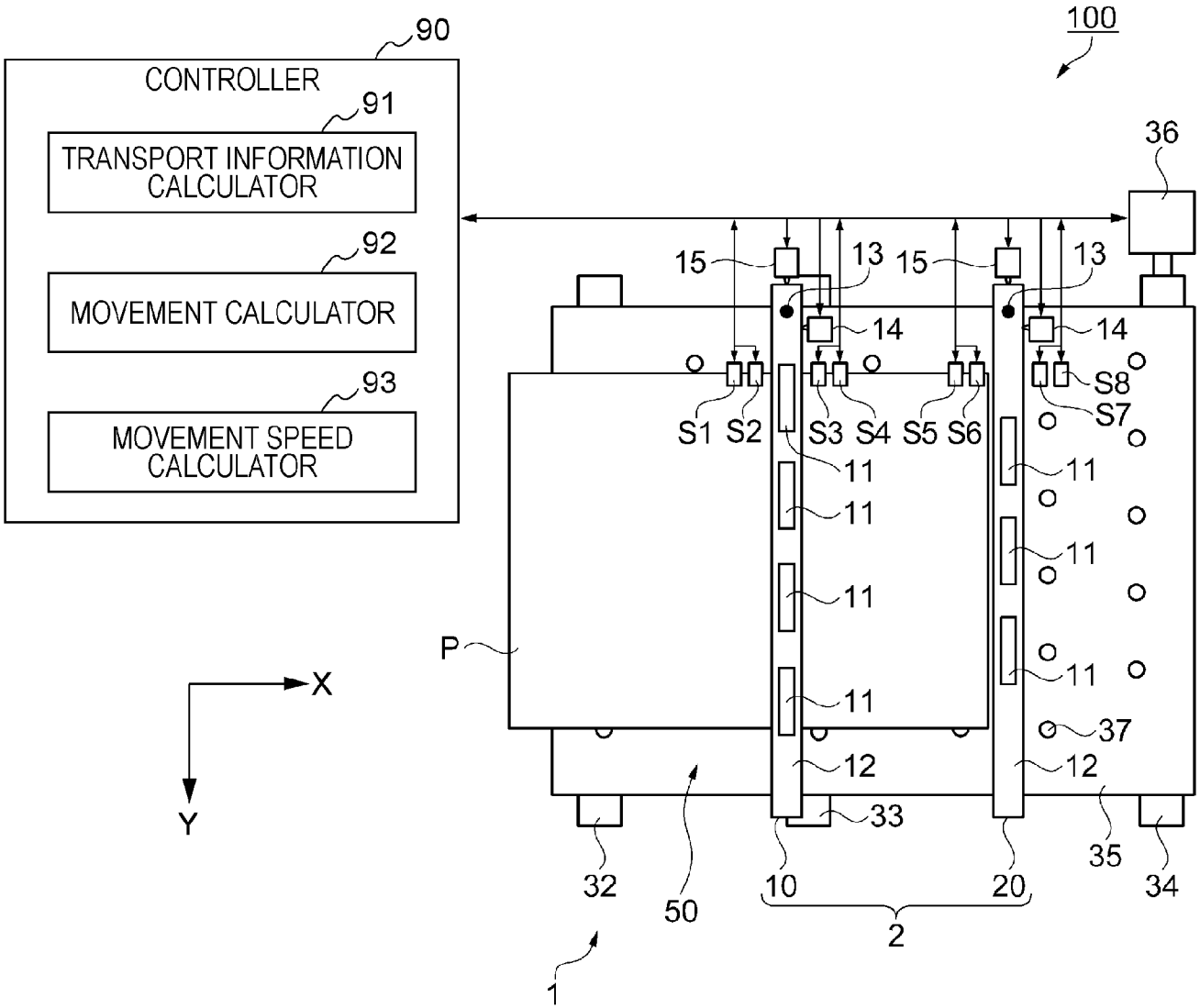
FIG. 2 is a plan view schematically illustrating the overall configuration of the ink jet printer according to the first embodiment.

FIG. 1 is a side sectional view schematically illustrating the overall configuration of an ink jet printer 100 according to the first embodiment. FIG. 2 is a plan view schematically illustrating the overall configuration of the ink jet printer 100. As shown in FIGS. 1 and 2, the ink jet printer 100 includes a transport mechanism 1 for holding and transporting a sheet P to be printed and a print mechanism 2 for performing printing on the sheet P held and transported by the transport mechanism 1. The operations of the transport mechanism 1 and the print mechanism 2 are controlled by a controller 90 shown in FIG. 2. In the following description of the ink jet printer 100, a regular transport direction of the sheet P is referred to as a transport direction X and a direction perpendicular to the transport direction X is referred to as a transport width direction Y.

As shown in FIG. 1, the transport mechanism 1 includes a gate roller 31 constituted by a pair of upper and lower nip rollers, a driven roller 32 disposed on the upstream side in the transport direction X, a driving roller 34 disposed on the downstream side in the transport direction X, and a tension roller 33 disposed below the driven roller 32 and the driving roller 34, an endless belt 35 moving around the three rollers 32, 33, and 34 in a loop shape.

The driving roller 34 is a roller which supplies a transport force to the endless belt 35 in the transport direction X. As shown in FIG. 2, a transport driving motor 36 which transfers power to the driving roller 34 is directly connected to the driving roller 34 at one end in the transport width direction Y. On the other hand, the driven roller 32 is a roller which is disposed so as to face the driven roller 34 in parallel at a certain interval at the same height.

The endless belt 35 is an endless belt-shaped member formed of an elastic material such as synthetic rubber or a resin film. Several air holes 37 are formed in the endless belt 35, as shown in FIG. 2. The sheet P is adsorbed or held through the air holes 37 by an adsorption device (not shown). The sheet P is adsorbed and held on a transport surface 50 on the endless belt 35 which transports the sheet P. Here, a negative pressure adsorption method or an electrostatic adsorption method can be used as an adsorption method of the adsorption device.

On the other hand, the print mechanism 2 includes a head unit 10 disposed on the upstream side in the transport direction X and a head unit 20 disposed on the downstream side in the transport direction X. The head units 10 and 20 each include a head panel 12 with a plurality of ejecting heads 11 for ejecting ink droplets, as shown in FIG. 2. The ejecting heads 11 are separated (spaced) in the head units 10 and 20 in the transport direction X so that four ejecting heads 11 are arranged in a row of the head unit 10 and three ejecting heads 11 are arranged in a row of the head unit 20. The ejecting heads 11 are also separated (spaced) in the transport width direction Y to be arranged alternately in the transport width direction Y on the upstream side and the downstream side in the transport direction X so that all the ejecting heads 11 are formed in a zigzag shape as a whole in a plan view.

The head units 10 and 20 can reciprocate in the transport width direction Y which is a direction parallel to the transport surface 50. The head units 10 and 20 can pivot clockwise and counterclockwise on a θ pivot shaft 13 perpendicular to the transport surface 50. That is, the head units 10 and 20 can pivot in a direction parallel to the transport surface 50.

The reciprocating movement and pivot of the head units 10 and 20 are described in detail below.

Figure 3:
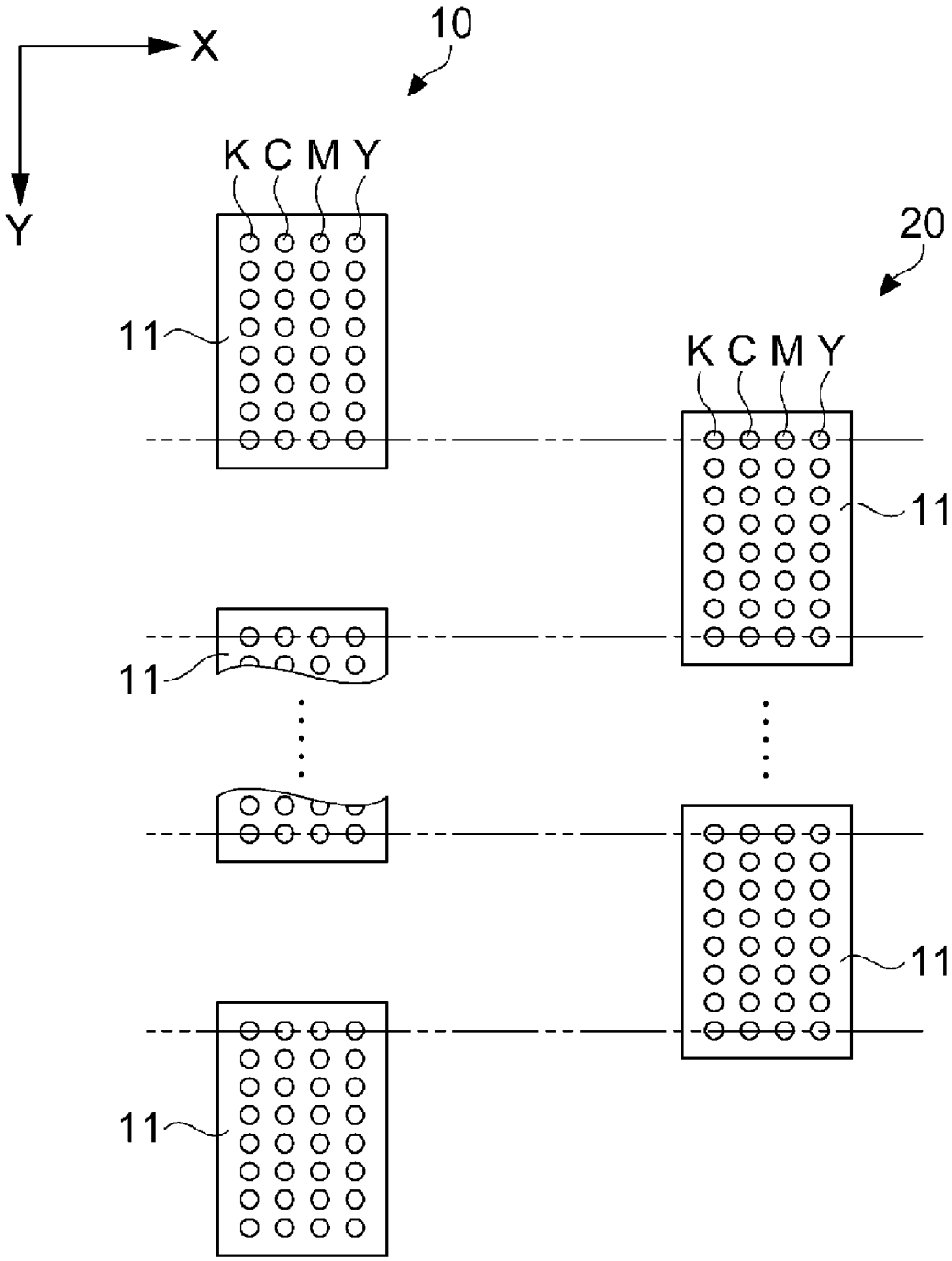
FIG. 3 is an explanatory diagram illustrating the arrangement of ejecting heads.

FIG. 3 is an explanatory diagram illustrating the arrangement of the ejecting heads 11 and illustrating the head units 10 and 20 viewed from the lower side. As shown in FIG. 3, multiple nozzles for ejecting ink droplets are formed on the surface (a nozzle surface) of each of the ejecting heads 11 facing the transport surface 50.

Specifically, four nozzle rows, which are constituted by a plurality of nozzles arranged in the transport width direction Y, are spaced in the transport direction X on each nozzle surface. The four nozzle rows can eject different color ink. In this embodiment, black (K) ink, cyan (C) ink, magenta (M) ink, and yellow (Y) ink are ejected in order from the upstream side in the transport direction X.

The nozzles at the end of each ejecting head 11 in the transport width direction Y overlap in the transport direction X with the nozzles at the ends of the adjacent ejecting heads 11, which are spaced in the transport direction X or the opposite direction of the transport direction X, in the transport width direction Y. Minute ink dots are formed on the sheet P by simultaneously ejecting appropriate amounts of ink droplets from appropriate nozzles in every color, that is, every nozzle row. The ink jet printer 100 repeats this operation while transporting the sheet P in the transport direction X. An image having a width corresponding to a distance between the nozzles at both the ends of the head units 10 and 20 in the transport width direction Y can be printed by one pass, that is, just by sending the sheet P in the transport direction X.

A method of ejecting ink from the nozzles is not limited to a specific method, but various methods such as an electrostatic method, a piezo method, and a film boiling ink jet method may be used.

The electrostatic method is a method of displacing a vibration plate in a cavity by giving driving pulses to an electrostatic gap and ejecting ink droplets by varying the pressure of the cavity with the displacement of the vibration plate. The piezo method is a method of displacing a vibration plate in a cavity by giving driving pulses to a piezo element and ejecting ink droplets by a variation in the pressure in the cavity caused due to the displacement of the vibration plate. The film boiling ink jet method is a method of heating ink by the use of a small heater disposed in a cavity and ejecting ink droplets by varying the pressure by generating bubbles.

Figure 4A:
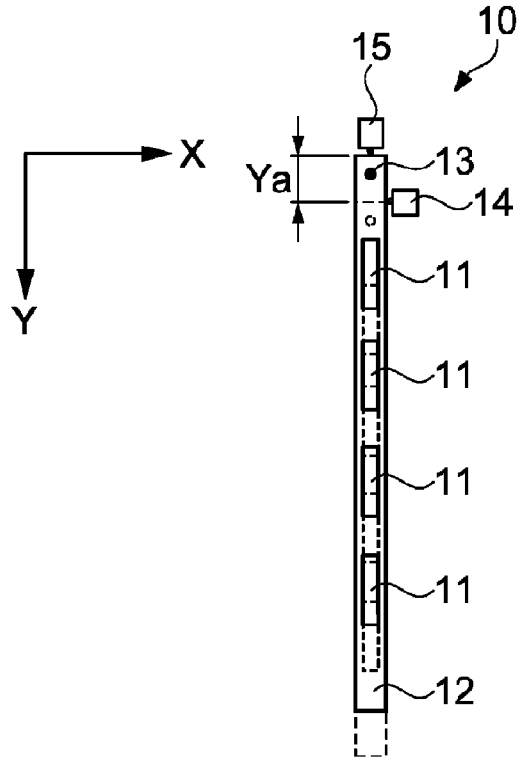
FIGS. 4A and 4B are explanatory diagrams illustrating a mechanism and the operation associated with the reciprocating movement and pivot of a head unit.
Figure 4B:
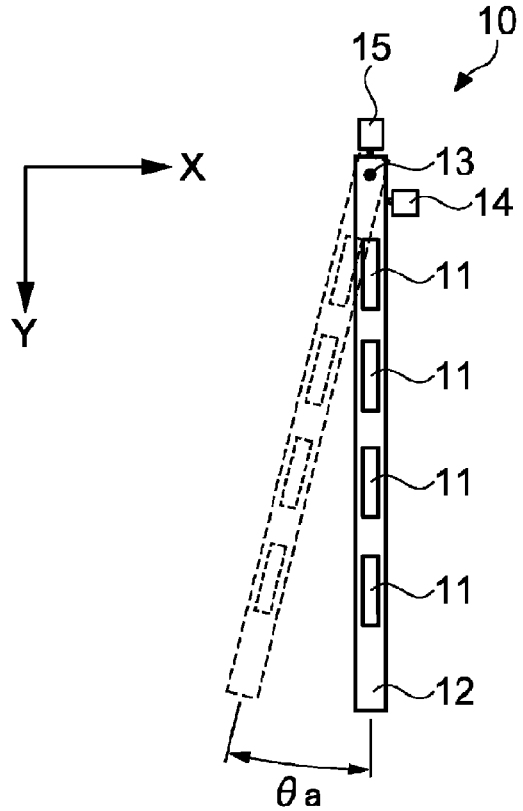

FIGS. 4A and 4B are explanatory diagrams illustrating a mechanism and the operation associated with the reciprocating movement and pivot of the head unit 10. In the head unit 10 shown in FIGS. 4A and 4B, there are disposed a Y axis motor 14 which transfers power for reciprocating the head panel 12 in the transport width direction Y, a slide rail (not shown) which extends in the transport width direction Y, and a θ axis motor 15 which transfers power for pivoting the head panel 12 on the θ pivot shaft 13. Like the head unit 10, the Y axis motor 14, the slide rail, and the θ axis motor 15 are also disposed in the head unit 20.

The head unit 20 can reciprocate in the transport width direction Y and pivot clockwise and counterclockwise on the θ pivot shaft 13.

In this embodiment, a linear ultrasonic motor capable of minutely controlling displacement, for example, is used as the Y axis motor 14 and the θ axis motor 15 disposed in each of the head units 10 and 20.

FIG. 4A shows that the head unit 10 moves by a distance Ya in the transport width direction Y from a reference position of the transport width direction Y. Here, the Y axis motor 14 is driven based on the control of the controller 90, the head unit 10 moves along the slide rail by the distance Ya in the transport width direction Y, and the head unit 10 thus moves to a position indicated by a dashed line.

FIG. 4B shows that the head unit 10 pivots on the θ pivot shaft 13 clockwise by an angle θa from the reference position. Here, the θ axis motor 15 is driven based on the control of the controller 90, the head unit 10 pivots on the θ pivot shaft 13 clockwise by the angle θa, and the head unit 10 thus pivots to a position indicated by a dashed line.

In a combination of FIGS. 4A and 4B, after the head panel 12 moves in the transport width direction Y by driving the Y axis motor 14, the head panel 12 can pivot on the θ pivot shaft 13 by driving the θ axis motor 15. Conversely, after the head panel 12 pivots on the θ pivot shaft 13 by driving the θ axis motor 15, the head panel 12 can move in the transport width direction Y by driving the Y axis motor 14. The head penal 12 can simultaneously pivot and move in the transport width direction Y.

Alternatively, as shown in FIG. 5, a Y axis cam 16 and a θ axis cam 17 may be disposed in the head unit 10 to reciprocate the head unit 10 in the transport width direction Y and pivot the head unit 10 clockwise and counterclockwise on the θ pivot shaft 13.

Figure 5A:
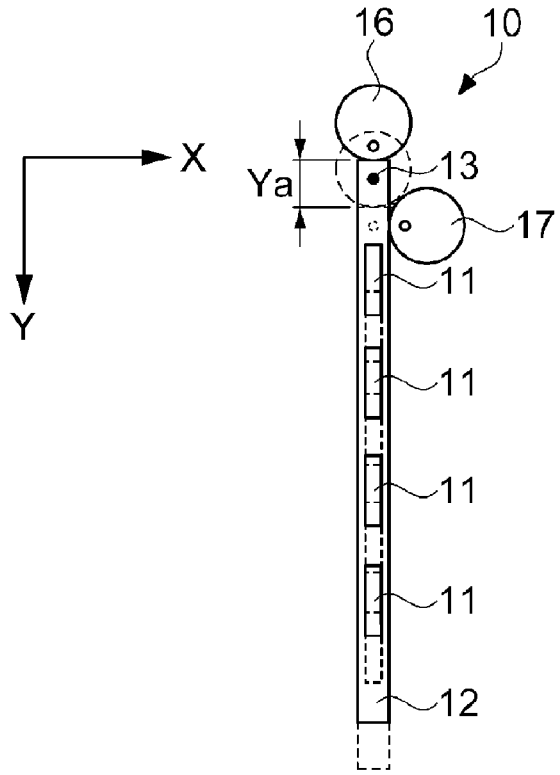
FIGS. 5A and 5B are explanatory diagrams illustrating a cam mechanism and the operation of associated with the reciprocating movement and pivot of the head unit.
Figure 5B:
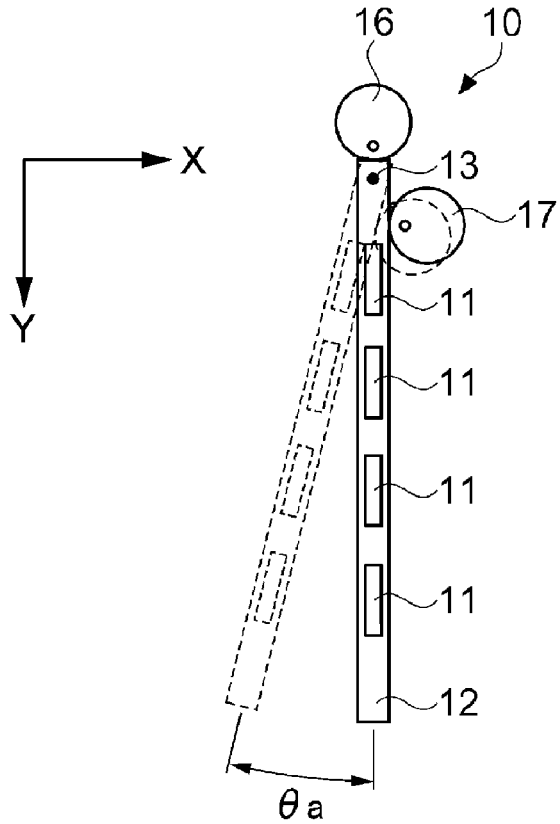

FIG. 5A shows that the head unit 10 moved by only the distance Ya in the transport width direction Y from the reference position in accordance with the pivot of the Y axis cam 16. FIG. 5B shows that the head unit 10 pivots clockwise on the θ pivot shaft 13 by the angle θa from the reference position in accordance with the pivot of the θ axis cam 17.

The positions of the θ pivot shaft 13, the Y axis motor 14, the θ axis motor 15, the Y axis cam 16, and the θ axis cam 17 are not limited to the positions shown in FIGS. 4A, 4B, 5A, and 5B.

In FIGS. 1 and 2, two edge sensors S1 and S2 disposed on the upstream side in the transport direction X and two edge sensors S3 and S4 disposed on the downstream side are arranged with the head unit 10 interposed therebetween. Moreover, two edge sensors S5 and S6 disposed on the upstream side in the transport direction X and two edge sensors S7 and S8 disposed on the downstream side are arranged with the head unit 20 interposed therebetween. The edge sensors S1 to S8 are a sensor serving as a detector which detects the end position in the width direction of the sheet P. For example, the edge sensors are a reflecting image sensor with a light-emitting element and light-receiving elements face the transport surface 50

The edge sensors S1 to S8 can detects the end position in the width direction of the sheet P on the transport surface 50 by emitting light from the light-emitting element toward the transport surface 50 and receiving the reflected light by the plurality of light-receiving elements. In this embodiment, for example, a CCD image sensor or a COMS image sensor may be used as the edge sensors S1 to S8.

Alternatively, the edge sensors S1 to S8 may automatically move to the positions to detect the end position in the width direction of the sheet P in accordance with the size of the sheet P in the width direction.

The controller 90 shown in FIG. 2 includes a CPU, a ROM, and a RAM (none of which are shown) to control the units and mechanisms of the ink jet printer 100 as a whole.

The controller 90 includes a transport information calculator 91, a movement calculator 92, and a movement speed calculator 93.

The transport information calculator 91 calculates transport information regarding the transport status of the sheet P on the transport surface 50. The transport information contains a position deviation degree, an incline degree, and a position deviation speed, an inclination speed of the sheet P. The position deviation degree and the incline degree are calculated based on the end position in the width direction of the sheet P detected by the edge sensors S1 to S8 when the sheet P is transported onto the transport surface 50. The position deviation speed represents the degree that the sheet P is deviated per unit time. The inclination speed represents the degree that the sheet P is inclined per unit time.

Here, the position deviation degree is the degree that the sheet P is deviated from a predetermined reference position in the width direction Y and represents a distance from the reference position to the end in the width direction of the sheet P. The incline degree represents the degree that the end in the width direction of the sheet P is inclined with respect to the transport direction X.

Based on the position deviation degree of the sheet P calculated by the transport information calculator 91, the movement calculator 92 calculates a movement distance for each of the head units 10 and 20 moved in the transport width direction Y. Based on the incline degree of the sheet P, the movement calculator 92 calculates a pivot angle formed on the θ pivot shaft 13 with respect to the head units 10 and 20.

Here, the widthwise movement distance which is calculated by the movement calculator 92 is a movement distance corresponding to the position deviation obtained by moving the head units 10 and 20 in the same direction as the deviated direction of the sheet P when the sheet P being passed below the head units 10 and 20 is deviated, for example.

The pivot angle calculated by the movement calculator 92 is a pivot angle corresponding to the incline degree obtained by pivoting the head units 10 and 20 by an inclined angle of the sheet P, when the sheet P being passed below the head units 10 and 20 is inclined, for example. That is, the movement calculator 92 calculates the pivot degree to make the head units 10 and 20 perpendicular to the ends in the width direction of the sheet P being passed below the head units 10 and 20.

Based on the position deviation speed of the sheet P calculated by the transport information calculator 91, the movement speed calculator 93 calculates a widthwise movement speed of the respective head units 10 and 20 which is formed when the sheet P moves in the transport width direction Y. Based on the inclination speed of the sheet P, the movement speed calculator 93 calculates the pivot speed formed upon the pivot on the θ pivot shaft 13 with respect to the head units 10 and 20

The head units 10 and 20, the edge sensors S1 to S8, the transport information calculator 91, the movement calculator 92, the movement speed calculator 93, and the controller 90 described above are included in the print position correcting device and have a function of correcting printing on the sheet P in accordance with the transport status of the sheet P.

The number and the disposed locations of the edge sensors are not limited to the above-mentioned number and the locations. For example, in order to detect the position of the sheet P, only one edge sensor or three or more edge sensors may be disposed on the upstream side and the downstream side with each of the head units 10 and 20 interposed therebetween. Alternatively, the edge sensor may be disposed only on the upstream side or the downstream side with the head units 10 and 20 interposed therebetween.

Next, the operation of the print position correcting device upon the printing will be described.

Figure 6:
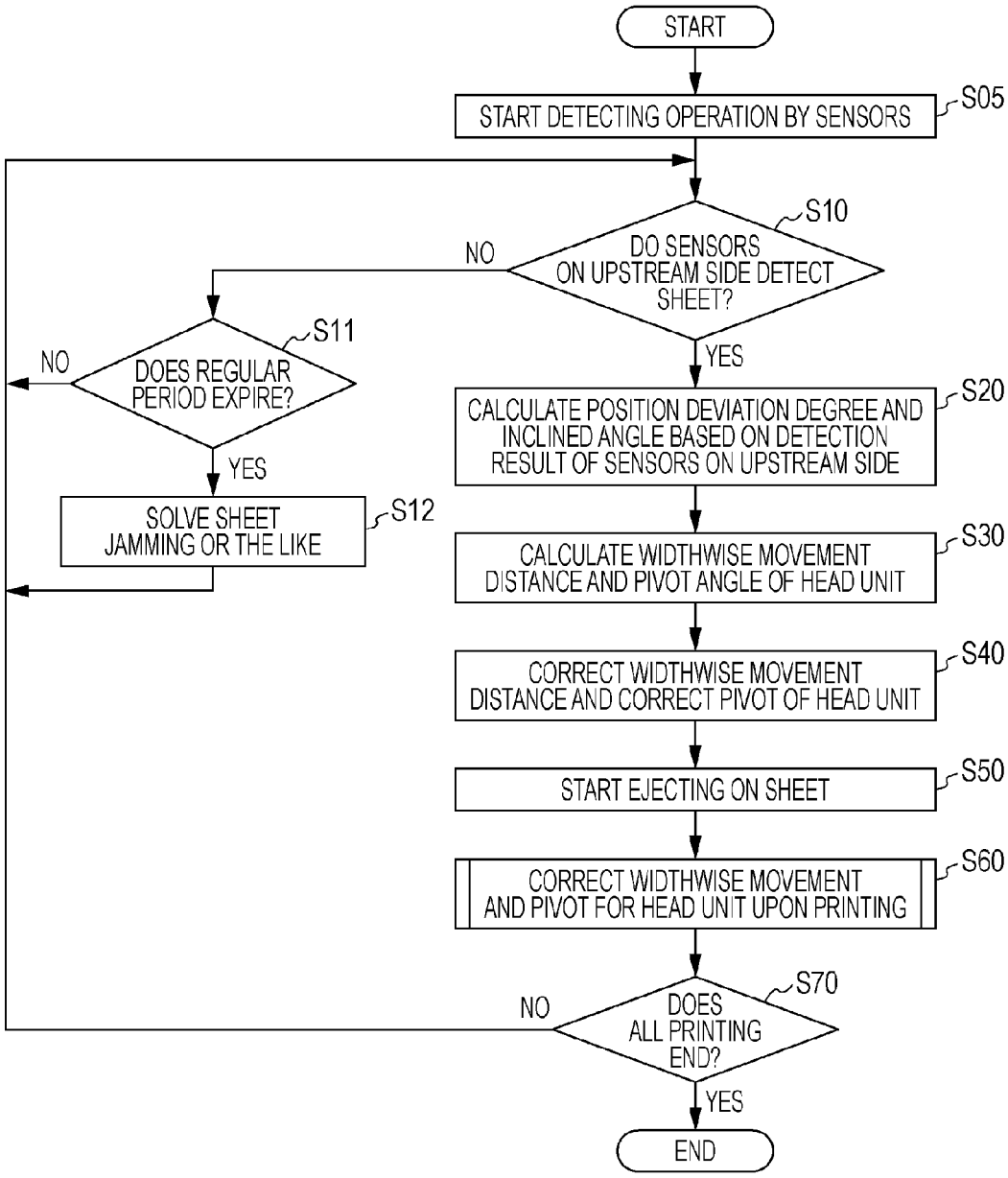
FIG. 6 is a flowchart illustrating the operation of a print position correcting device upon printing.

FIG. 6 is a flowchart illustrating the operation of the print position correcting device upon the printing. As shown in FIG. 6, the operation starts when the sheet P to be printed is transported onto the transport surface 50. Here, the operation in the head unit 10 will be described, but the operation is also applicable to the head unit 20.

In step S05, the controller 90 first controls the edge sensors S1 to S4 of the head unit 10 disposed on the upstream side and the downstream side to start a detection operation in the edge sensors S1 to S4.

In step S10, the controller 90 determines whether the edge sensors S1 and S2 of the head unit 10 disposed on the upstream side detect the end position in the width direction of the sheet P. When it is determined that both the edge sensors S1 and S2 detect the end position in the width direction of the sheet P, the operation proceeds to step S20.

Alternatively, the operation proceeds to step S11, when it is determined that neither the edge sensor S1 nor the edge sensor S2 detects the end position in the width direction of the sheet P. Then, the controller 90 determines whether a regular period has elapsed since the sheet P was transported onto the transport surface 50.

Here, the regular period is a period obtained when a period taken for the sheet P transported onto the transport surface 50 to pass through both the edge sensors S1 and S2 exceeds an allowed period. Accordingly, when the regular period expires, the controller 90 determines that the sheet P is jammed or the sheet P is transported in a considerably deviated state to the extent that the edge sensors S1 and S2 cannot detect the end position.

When the regular period expires in step S11, the operation proceeds to step S12. Then, the controller 90 solves the sheet jamming. When the sheet jamming is completely solved in step S12, the operation returns to step S10. Then, the controller 90 determines once again whether the edge sensors S1 and S2 detect the end position in the width direction of the sheet P. In addition, in solving the sheet jamming, the controller 90 displays a message indicating the jamming of the sheet P on an operation screen (not shown) for the user to resolve. Alternatively, when the regular period does not expire, the operation returns to step S10 determine once again whether the edge sensors detect the end position in the width direction of the sheet P.

In step S20, the controller 90 allows the transport information calculator 91 to calculate the position deviation degree and the incline degree of the sheet P based on the detection result obtained in step S10 by the edge sensors S1 and S2 disposed on the upstream side. Specifically, the position deviation degree and the incline degree of the sheet P are calculated based on the end position in the width direction of the sheet P detected by each of the edge sensors S1 and S2.

In step S30, based on the position deviation degree and the incline degree calculated in step S20, the controller 90 allows the movement calculator 92 to calculate the movement distance of the head unit 10 in the width direction Y and the pivot angle of the head unit 10 formed on the θ pivot shaft 13.

In step S40, based on the movement distance of the head unit 10 in the width direction Y and the pivot angle of the head unit 10, which are calculated in step S30, the controller 90 moves the head unit 10 at the maximum speed to correct the movement in the width direction Y on the head unit 10 or correct the pivot on the θ pivot shaft 13 on the head unit 10.

Here, when the widthwise movement distance and the pivot angle calculated in step S30 are all zero, that is, when the sheet P is not deviated and inclined, neither a widthwise movement correction nor a pivot correction of the head unit 10 are not performed.

Alternatively, when the widthwise movement distance is not zero and the pivot angle is zero, that is, when the sheet P is just deviated and not inclined, only the widthwise movement correction of the head unit 10 is performed, for example, as in FIG. 4A.

Alternatively, when the widthwise movement distance is zero and the pivot angle is not zero, that is, when the sheet P is just inclined and not deviated, only the pivot correction of the head unit 10 is performed, for example, as in FIG. 4B.

Alternatively, when the widthwise movement distance is not zero and the pivot angle is also not zero, that is, when the sheet P is inclined and deviated, both the widthwise movement correction and the pivot correction on the head unit 10 are performed, for example, as in the combination of FIGS. 4A and 4B.

In step S50, the controller 90 starts ejecting the ink droplets onto the sheet P from the head unit 10 subjected in step S40 to the widthwise movement correction or the pivot correction. In this way, the printing on the sheet P starts.

In step S60, based on the detection result of the edge sensors S3 and S4 of the head unit 10 disposed on the downstream side, the controller 90 performs the widthwise movement correction or the pivot correction of the head unit 10. The correction of the head unit 10 is an operation performed upon the printing (while the ink droplets are ejected). This correction is performed until the printing corresponding to P1 pieces of sheet ends.

Each correction of the head unit 10 upon the printing is described in detail below.

In step S70, the controller 90 determined whether the printing on all of the sheets P to be printed has ended. The printing ends, when it is determined that the printing on all the sheets P has ended. Alternatively, when the sheet P to be printed remains, the operation returns to step S10 to once more determine whether the edge sensors detect the end position in the width direction of the subsequent sheet P.

Figure 7:
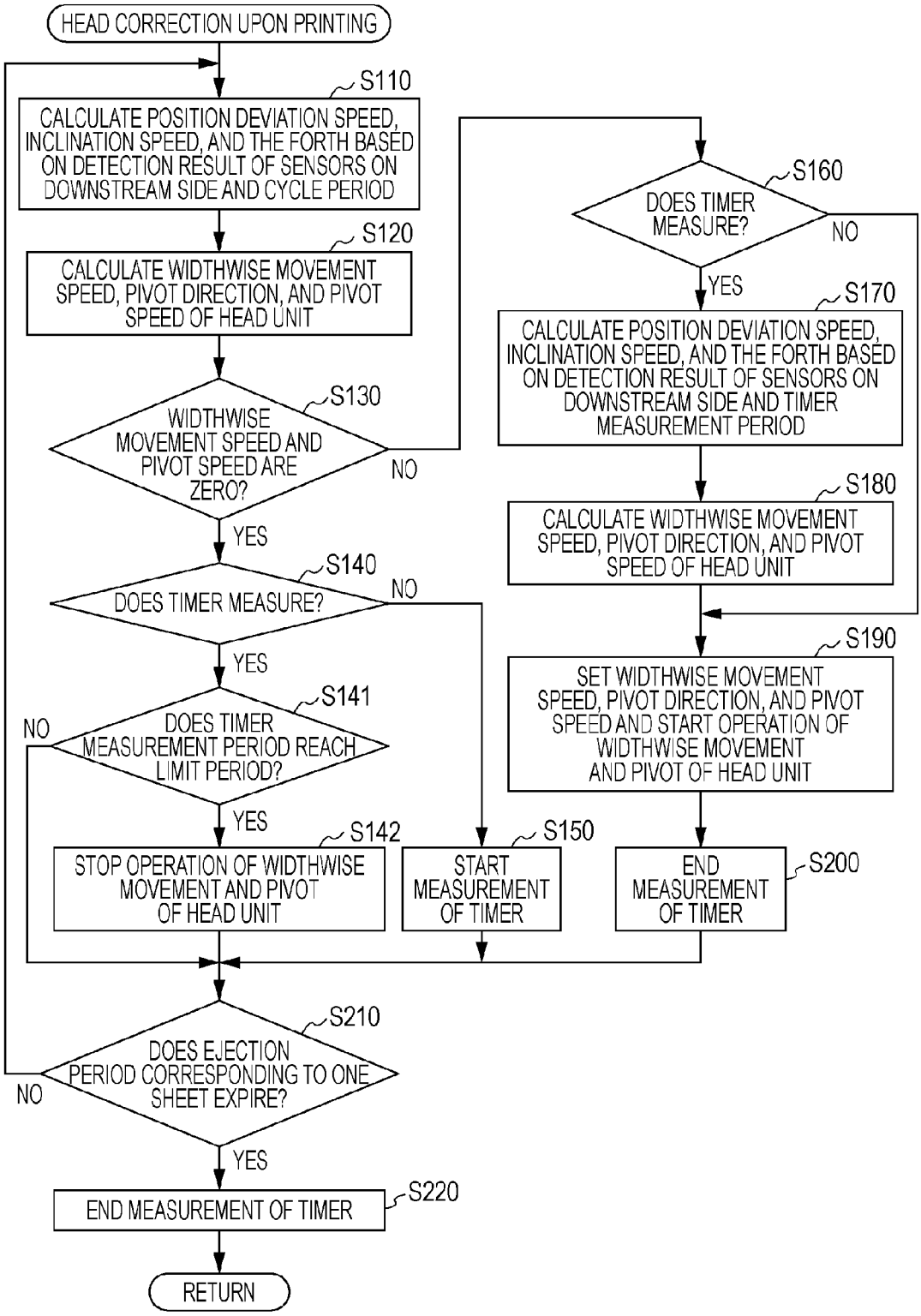
FIG. 7 is a flowchart illustrating each correction of the head unit upon the printing in detail.

Next, each correction of the head unit 10 upon the printing will be described. FIG. 7 is a flowchart illustrating each correction of the head unit 10 upon the printing in detail.

In step S110, based on the detection result of the edge sensors S3 and S4 on the downstream side and a cycle period, the controller 90 allows the transport information calculator 91 to calculate the position deviation degree, the incline degree, the position deviation speed, and the inclination speed of the sheet P.

In order to calculate the position deviation speed and the inclination speed of the sheet P, the position deviation degree of the sheet P is first calculated to calculate the position deviation speed based on the end position in the width direction of the sheet P detected by the edges sensor S3. Next, a displacement value between the previously calculated position deviation degree and the present calculated position deviation degree is evaluated, and then the position deviation degree per the cycle period is calculated to be set as the position deviation speed of the sheet P.

On the other hand, the incline degree of the sheet P is calculated to calculate the inclination speed based on the end position in the width direction of the sheet P which is detected by the edge sensors S3 and S4. Next, the displacement value between the previously calculated incline degree and the present incline degree is evaluated, and then the incline degree per the cycle time is calculated to be set as the inclination speed of the sheet P.

The cycle period indicates a period for which the edge sensors S3 and S4 detects the end position in the width direction of the sheet P at the previous time and then detects the end position at the present time. That is, the cycle period is an interval at which the operation of step S110 repeats.

In step S120, based on the position deviation degree, the incline degree, the position deviation speed, the inclination speed of the sheet P calculated in step S110, the controller 90 allows the movement speed calculator 93 to calculate the widthwise movement speed in the width direction Y, the pivot direction, and the pivot speed of the head unit 10 on the θ pivot shaft 13.

In step S130, the controller 90 determines whether both the widthwise movement speed and the pivot speed of the head unit 10 calculated in step S120 are zero. When both the widthwise movement speed and the pivot speed are zero, that is, when the position of the sheet P detected in step S110 is the same as the position detected at the previous time, the operation proceeds to the subsequent step S140.

Here, there are two cases where the position of the sheet P detected at the present time is the same as the position detected at the previous time. One case is that the position of the sheet P detected at the present time is actually the same as the position detected at the previous time. The other case is that the position of the sheet P is slightly different from the position detected at the previous time but the displacement is too small to recognize the position difference with the resolution capability of the sensors.

In step S140, the controller 90 determines whether a timer executes measurement. When it is determined that the timer does not execute measurement, the measurement of the timer starts in step S150 to determine an ejection period corresponding to the P1 sheets in step S210.

The timer measures an elapsed period after it is determined in step S130 that the widthwise movement speed and the pivot speed are zero. That is, a timer measurement period indicates a cumulative period for which the position of the sheet P detected at the present time is the same as the position detected at the previous time.

Alternatively, when the timer executes measurement in step S140, the operation proceeds to step S141. In step S141, the controller 90 determines whether the timer measurement period has reached a limit period. When the timer measurement period has reached the limit period, the controller 90 interrupts a driving mechanism to stop the widthwise movement operation and the pivot operation of the head unit 10 in step S142 in a case where a driving mechanism such as the Y axis motor 14 and the θ axis motor 15 for driving the head unit 10 operates. Alternatively, when the timer measurement period does not reach the limit period, the operation of step S142 is skipped. Then, the determination of the ejection period corresponding to the P1 sheets is executed in step S210.

The above-described limit period is a regular period used to determine that the position of the sheet P is not displaced even in spite of the passing of time when the detected position of the sheet P is the same as the position of the sheet P detected at the previous time. Accordingly, the fact that the timer measurement period reaches the limit period means that the sheet P is not deviated and pivoted.

Alternatively, when it is determined in step S130 that either one of the widthwise movement speed and the pivot speed is not zero, that is, when the position of the sheet P detected in step S110 is different from the position of the sheet P detected at the previous time, the operation proceeds to step S160.

In step S160, the controller 90 determines whether the timer executes the measurement. When it is determined that the timer executes the measurement, the operation proceeds to step S170. Then, based on the detection result of the edge sensors S3 and S4 on the downstream side and the timer measurement period, the controller 90 calculates the position deviation degree, the incline degree, the position deviation speed, and the inclination speed of the sheet P.

Here, the position deviation speed and the inclination speed are displacement values of the position deviation degree and the incline degree per timer measurement period, that is, per the cumulative period for which the detected position of the sheet P is the same as the position of the sheet P detected at the previous time.

Subsequently, the operation proceeds to step S180. Then, based on the position deviation degree, the incline degree, the position deviation speed, and the inclination speed of the sheet P calculated in step S170, the controller 90 allows the movement speed calculator 93 to calculate the widthwise movement speed, the pivot direction, and the pivot speed of the head unit 10.

Alternatively, when it is determined in step S160 that the timer does not execute the measurement, steps S170 and 5180 in which the widthwise movement speed, the pivot direction, and the pivot speed of the head unit 10 are calculated are skipped, and the operation proceeds to step S190.

Here, a case where it is determined that the position of the sheet P is also different from the position of the sheet P detected at the previous time after it determined that the widthwise movement speed and the pivot speed are not zero corresponds to the case where it is determined in step S160 that the timer does not execute the measurement. That is, this case corresponds to a case where the displacement value between the position deviations or the inclinations of the sheet P calculated at the previous time and the present time is not small and thus can be recognized by the resolution capability of the sensors.

In step S190, based on the widthwise movement speed, the pivot direction, and the pivot speed of the head unit 10 calculated in step S180 or 5120, the controller 90 starts a widthwise movement operation to move the head unit 10 in the transport width direction Y or a pivot operation to pivot the head unit 10 on the θ pivot shaft 13. At this time, the driving mechanism for driving the head unit 10 is controlled to deliver power suitable for the calculated widthwise movement speed and the calculated pivot speed.

In this way, the widthwise movement operation or the pivot operation are started at the calculated widthwise movement speed and the calculated pivot speed for the head unit 10 which is at that moment stopped or moving. Then, while the widthwise movement operation or the pivot operation are performed on the head unit 10, the widthwise movement correction is performed to correct the head unit 10 in the transport width direction Y and the correction of the pivot on the θ pivot shaft 13 is performed.

Subsequently, the measurement of the timer in step S200 ends in the state where the widthwise movement operation or the pivot operation are performed on the head unit 10. Then, the operation proceeds to step S210.

In step S210, the controller 90 determines whether the ejection period corresponding to the P1 sheets has expired.

The operation proceeds to the subsequent step S220, when it is determined that the ejection period has expired. Then, the controller 90 terminates the measurement of the timer and terminates each correction of the head unit 10 and the printing corresponding to the P1 pieces of sheet. Alternatively, when the ejection period does not expire in step S210, the operation returns to step S110 in that the printing corresponding to the P1 sheets continues and the sheet P is transported. Then, the position deviation speed, the inclination speed of the sheet P, and so forth are calculated based on the detection result of the edge sensors S3 and S4.

Instead of determining whether the ejection period has expired, it may be determined whether the printing corresponding to the P1 sheets has ended by providing a sensor for detecting the end of each of the P1 sheets.

Next, the movement correction and the pivot correction of the head units 10 and 20 will be described in more detail. FIGS. 8A1 to 8E2 are diagrams illustrating examples where each correction is performed or not on the head unit 10. FIGS. 8A1, 8B1, 8C1, 8D1, and 8E1 show print examples where each correction is not performed. On the other hand, FIGS. 8A2, 8B2, 8C2, 8D2, and 8E2 show print examples where each correction is performed. The drawing shows that the head unit 10 is interposed between the sheet P on the upstream side in the transport direction X before the printing and the sheet P on the downstream side in the transport direction X after the printing. White arrows indicate the direction in which the sheet P is transported. Here, the examples of each correction of the head unit 10 will be described, but the same is applicable to the head unit 20.

In FIG. 8A1, the sheet P in an appropriate posture is transported in the transport direction X, but the entire sheet P is deviated in the transport width direction Y. For this reason, the entire rectangular print image G biased to the end of the sheet P is printed in FIG. 8A1 where the correction is not performed. On the contrary, in FIG. 8A2, the image is printed after the widthwise movement correction is performed on the head unit 10. As a consequence, by performing the widthwise movement correction, the rectangular print image G is printed at an appropriate position of the middle of the sheet P in FIG. 8A2.

In FIG. 8B1, the sheet P in the inclined alignment is transported in the transport direction X. For this reason, the entire rectangular print image G is printed on the sheet P in the inclined state in FIG. 8B1 where the correction is not performed. On the contrary, in FIG. 8B2, the image is printed while the head unit 10 is moved in a direction opposite to the transport width direction Y at the calculated widthwise movement speed in the state where the head unit 10 is put in a position perpendicular to the end in the width direction of the sheet P by performing the pivot correction. As a consequence, by performing the widthwise movement correction and the pivot correction, the rectangular print image G is printed at the appropriate position of the middle of the sheet P in FIG. 8B2.

In FIG. 8C1, the sheet P is in the appropriate alignment, but transported in a direction oblique with respect to the transport direction X. For this reason, the print image G which was to be printed in an exactly rectangular shape is printed on the sheet P in an inclined parallelogram shape and not in a rectangular shape unless the correction is performed in FIG. 8C1, since the image G is deviated upon the printing. On the contrary, in FIG. 8C2, the image is printed while the head unit 10 is moved in the transport width direction Y at the calculated widthwise movement speed. As a consequence, by performing the widthwise movement correction, the print image G with the appropriate rectangular shape is printed at the appropriate position of the middle of the sheet P in FIG. 8C2.

In FIG. 8D1, the sheet P in the inclined alignment is transported in a direction oblique with respect to the transport direction X. For this reason, the print image G which was to be printed in an exactly rectangular shape is printed on the sheet P in a parallelogram shape and not in a rectangular shape unless the correction is performed in FIG. 8D1, since the image G is deviated upon the printing. On the contrary, in FIG. 8D2, the image is printed after the head unit 10 is put in a position perpendicular to the end in the width direction of the sheet P by performing the pivot correction. As a consequence, by performing the pivot correction, the appropriate rectangular print image G is printed on the middle of the sheet P in FIG. 8D2.

In FIG. 8E1, the sheet P inclined with respect to the transport direction X is transported. For this reason, the print image G which was to be printed in an exactly rectangular shape is printed on the sheet P in a curved and distorted shape not in the rectangular shape unless the correction is performed in FIG. 8E1, since the image G is deviated upon the printing. On the contrary, in FIG. 8E2, the image is printed after the head unit 10 is put in a position perpendicular to the end in the width direction of the sheet P while the head unit 10 pivots at the calculated pivot speed. As a consequence, by performing the pivot correction, the appropriate rectangular print image G is printed on the middle of the sheet P in FIG. 8E2.

As described above, the following advantages can be obtained according to the ink jet printer 100 of this embodiment.

In the ink jet printer 100 of this embodiment, the widthwise movement correction or the pivot correction is performed on the head units 10 and 20 in accordance with the position deviation degree and the incline degree of the sheet P calculated based on the detection result of the edge sensors S1 to S8. Accordingly, when sheet P is position-deviated in the transport width direction Y, transported in the inclined state, transported in the oblique direction, or transported in a meandering state, for example, the relative position of the sheet P and the head units 10 and 20 can be matched with each other by performing the widthwise movement correction, the pivot correction, and a combination of the widthwise movement correction and the pivot correction in accordance with the transported state. In this way, since an image can be formed on the intended region of the sheet P, it is possible to form the image having a high resist precision and no irregularity.

When the position deviated state or the inclined state of the sheet P is changed with time, the widthwise movement correction or the pivot correction is performed on the head units 10 and 20 while the widthwise movement operation or the pivot operation are continuously performed at the position deviation speed or the inclination speed of the sheet P. In this way, the ink jet printer 100 can be made silent in that it is not necessary to drive and stop the motor or the like whenever the head units 10 and 20 are corrected and no unnecessary vibration occurs.

When a change in the position deviation or the inclination of the sheet P is not uniform but varied, the position deviation or the inclination is handled by performing the widthwise movement correction or the pivot correction of the head units 10 and 20 and changing the speed. In this way, it is possible to make the response speed faster in response to the position deviated state or the inclined state of the sheet P.

In a method of moving the head units 10 and 20 by only the displacement value to handle the displacement of the position deviation degree and the incline degree of the sheet P, a sensor having a poor resolution capability, such as a sensor having a resolution capability of 100 μm, for example, repeats an operation of moving the head units 10 and 20 by 100 μm at one time and stopping them when detecting the displacement of the sheet P. Therefore, the irregularity may occur in a print image since the operation of the head units 10 and 20 is not smoothly performed.

In this embodiment, the displacement speed of the position deviation degree and the incline degree of the sheet P is reflected on the speed of the widthwise movement operation and the pivot operation of the head units 10 and 20. Accordingly, even when the sensor having a poor resolution capability is used, the widthwise movement correction or the pivot correction is performed while the widthwise movement operation or the pivot operation is continuously performed on the head units 10 and 20 at the calculated speed. In this way, since the operation of the head units 10 and 20 can be smoothly performed, it is possible to prevent irregularity in the print image.

When the pivot correction is made on the position perpendicular to the end in the width direction of the sheet P after the pivot correction of the head unit 10, it is possible to maintain an ideal position at which the ink droplets are normally ejected in a direction perpendicular to the sheet P from the head units 10 and 20. Accordingly, the intended image effect is not damaged upon printing image data generated in advance by image processing and matched with the ejection characteristics or image data generated to make sure the irregularity due to error variance or the like does not occur.

By performing the widthwise movement correction or the pivot correction of the head units 10 and 20 at a high speed and with a high precision, it is possible to detect the minute movement (a level of several tens of μm) of the sheet p caused due to the eccentricity or vibration of each roller of the transport mechanism 1 which is varied every moment during the transportation of the sheet P.

A mechanism for correcting the inclination of the sheet P or matching the front end position of the sheet P is not required, since it is not necessary to correct the position or the alignment of the sheet P in the front of the head units 10 and 20. In this way, it is possible to obtain an advantage in terms of the cost of the ink jet printer 100.

Second Embodiment

Next, an ink jet printer 200 according to a second embodiment will be described. Here, the same reference numerals are given to the same constituent elements as those of the first embodiment, and the detailed description is omitted.

Figure 9:
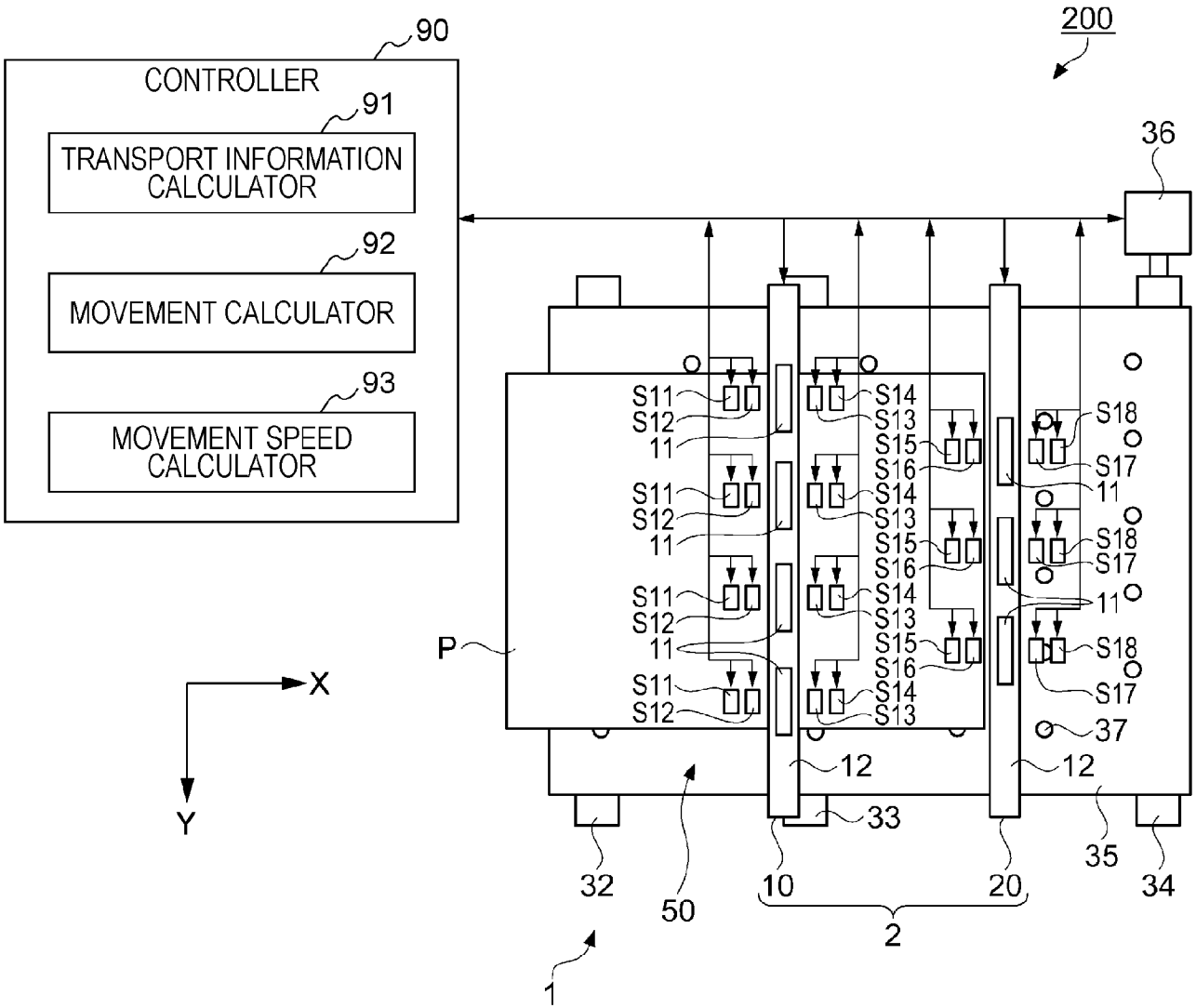
FIG. 9 is a plan view schematically illustrating the overall configuration of an ink jet printer according to a second embodiment.
Figure 10A:
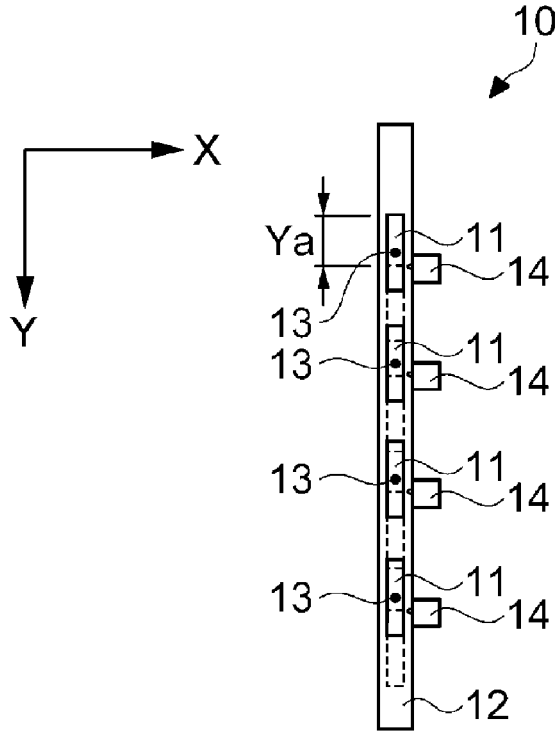
FIGS. 10A and 10B are explanatory diagrams illustrating a mechanism and the operation associated with the reciprocating movement and pivot of a head unit according to the second embodiment.
Figure 10B:
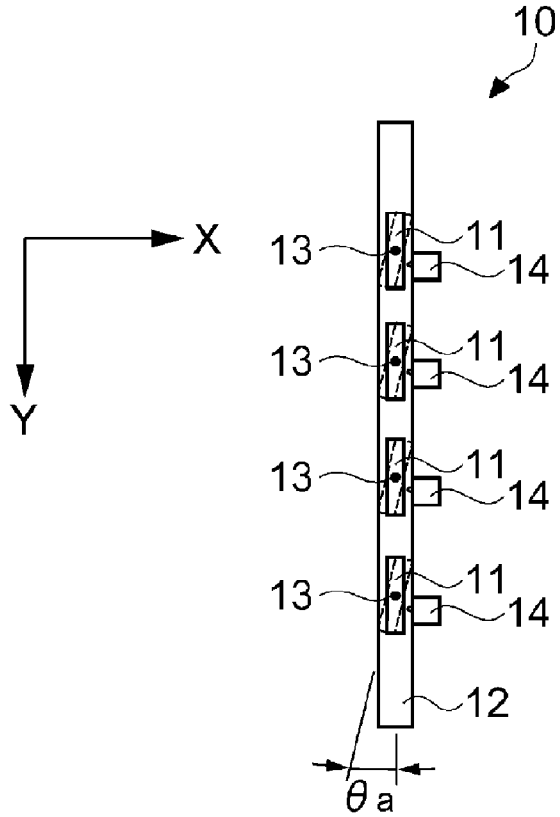

The ink jet printer 100 according to the first embodiment and the ink jet printer 200 according to the second embodiment are different from each other in the mechanism and operation associated with the movement and pivot of the head units 10 and 20 and the arrangement of the sensors detecting the position of the sheet P. FIG. 9 is a plan view schematically illustrating the overall configuration of the ink jet printer 200 according to the second embodiment. FIGS. 10A and 10B are explanatory diagrams illustrating the mechanism and the operation associated with the reciprocating movement and pivot of the head unit 10 according to the second embodiment. Here, the head unit 10 will be described, but the same is applicable to the head unit 20.

In the head unit 10 according to the first embodiment, the entire head unit 10 can reciprocate and pivot. However, in the head unit 10 according to the second embodiment shown in FIGS. 10A and 10B, each of the ejecting heads 11 disposed in the head unit 10 can reciprocate and pivot. With such a configuration, the Y axis motor 14 for transferring power to reciprocate each ejection head 11 in the transport width direction Y, the slide rail (not shown) extending in the transport width direction Y, and the θ axis motor (not shown) for transferring power to pivot each ejection head 11 on the θ pivot shaft 13 are disposed in each of the ejecting heads 11.

FIG. 10A shows that each ejecting head 11 moves by only the distance Ya in the transport width direction Y from the reference position of the transport width direction Y. Here, the Y axis motors 14 for moving the ejecting heads 11 are driven based on the control of the controller 90, and then these ejecting heads 11 move by the distance Ya in the transport width direction Y along the slide rail so as to move to the position indicated by a dashed line. In FIG. 10A, all of the ejecting heads 11 move, but only the ejecting heads 11 to be moved can be appropriately selected.

FIG. 10B shows that each ejecting head 11 pivots on the θ pivot shaft 13 clockwise by the angle θa from the reference position. Here, the θ axis motor for pivoting the ejecting heads 11 is driven based on the control of the controller 90, and then these ejecting heads 11 pivot on the θ pivot shafts 13 clockwise by the angle θa so as to pivot to the position indicated by a dashed line. In FIG. 10B, all of the ejecting heads 11 pivot, but only the ejecting heads 11 to be pivoted can be appropriately selected.

Here, in a combination of FIGS. 10A and 10B, after the ejecting heads 11 move in the transport width direction Y by driving the Y axis motors 14 for moving the ejecting heads 11, the ejecting heads 11 can pivot on the θ pivot shafts 13 by driving the θ axis motors for pivoting the ejecting heads 11. Conversely, after the ejecting heads 11 pivots on the θ pivot shafts 13 by driving the θ axis motors for the ejecting heads 11 to be pivoted, these ejecting heads 11 can move in the transport width direction Y by driving the Y axis motors 14 for moving the ejecting heads 11. The ejecting heads 11 can simultaneously pivot and move in the transport width direction Y.

Here, the ejecting heads 11 for the movement, the ejecting heads 11 for the pivot, and the ejecting heads 11 for both the movement and the pivot can coexist in the head unit 10

Unlike the ink jet printer 100 according to the first embodiment, as shown in FIG. 9, discriminative sensors S11 to S18 serving as the detectors for discriminating a mark or the like on the sheet P are disposed instead of the edge sensors S1 to S8 for detecting the end position in the width direction of the sheet P in the ink jet printer 200 according to the second embodiment. The discriminative sensors S11 to S18 are disposed in each of the ejecting heads 11 arranged in each of the head units 10 and 20. Two discriminative sensors S11 and S12 disposed on the upstream side in the transport direction X and two discriminative sensors S13 and S14 disposed on the downstream side in the transport direction X are arranged in each of the ejecting heads 11 with the head unit 10 interposed therebetween. Two discriminative sensors S15 and S16 disposed on the upstream side in the transport direction X and two discriminative sensors S17 and S18 disposed on the downstream side in the transport direction X are arranged in each of the ejecting heads 11 with the head unit 20 interposed therebetween.

Based on the discriminated position of the mark or the like detected when the sheet P transported on the transport surface 50 passes through the discriminative sensors S11 to S18, the transport information calculator 91 calculates the position deviation degree, the incline degree, the position deviation speed, and the inclination speed of the sheet P passing below each ejecting head 11.

Based on the position deviation degree and the incline degree calculated by the transport information calculator 91, the movement calculator 92 calculates the widthwise movement distance of each ejecting head 11 in the transport width direction Y and the pivot angle on the θ pivot shaft 13 of each ejecting head 11.

Based on the position deviation speed and the inclination speed calculated by the transport information calculator 91, the movement speed calculator 93 calculates the widthwise movement speed of each ejecting head 11 in the transport width direction Y and the pivot speed achieved when each ejecting head 11 pivots on the θ pivot shaft 13. Based on the widthwise movement distance, the pivot angle, the widthwise movement speed, the pivot direction, and the pivot speed of each ejecting head 11 calculated by the movement calculator 92 and the movement speed calculator 93, the controller 90 performs the widthwise movement correction or the pivot correction of each ejecting head 11.

In the ink jet printer 200 according to this embodiment, the position deviation degree, the incline degree, the position deviation speed, and the inclination speed of the sheet P passing below each ejecting head 11 are calculated based on the detection result of the discriminative sensors S11 to S18 disposed in each of the ejecting heads 11 to perform the widthwise movement correction or the pivot correction of each ejecting head 11. With such a configuration, it is possible to precisely handle the partial expansion and contraction of the sheet P caused due to the heat or the ejection of the ink droplets, for example.

Since the automatic alignment of the ejecting heads 11 is possible through the detection of a test pattern printed on the sheet P by the discriminative sensors S11 to S18, it is possible to reduce load associated with the assembly of the ink jet printer 200.

Modified Examples

Figure 11:
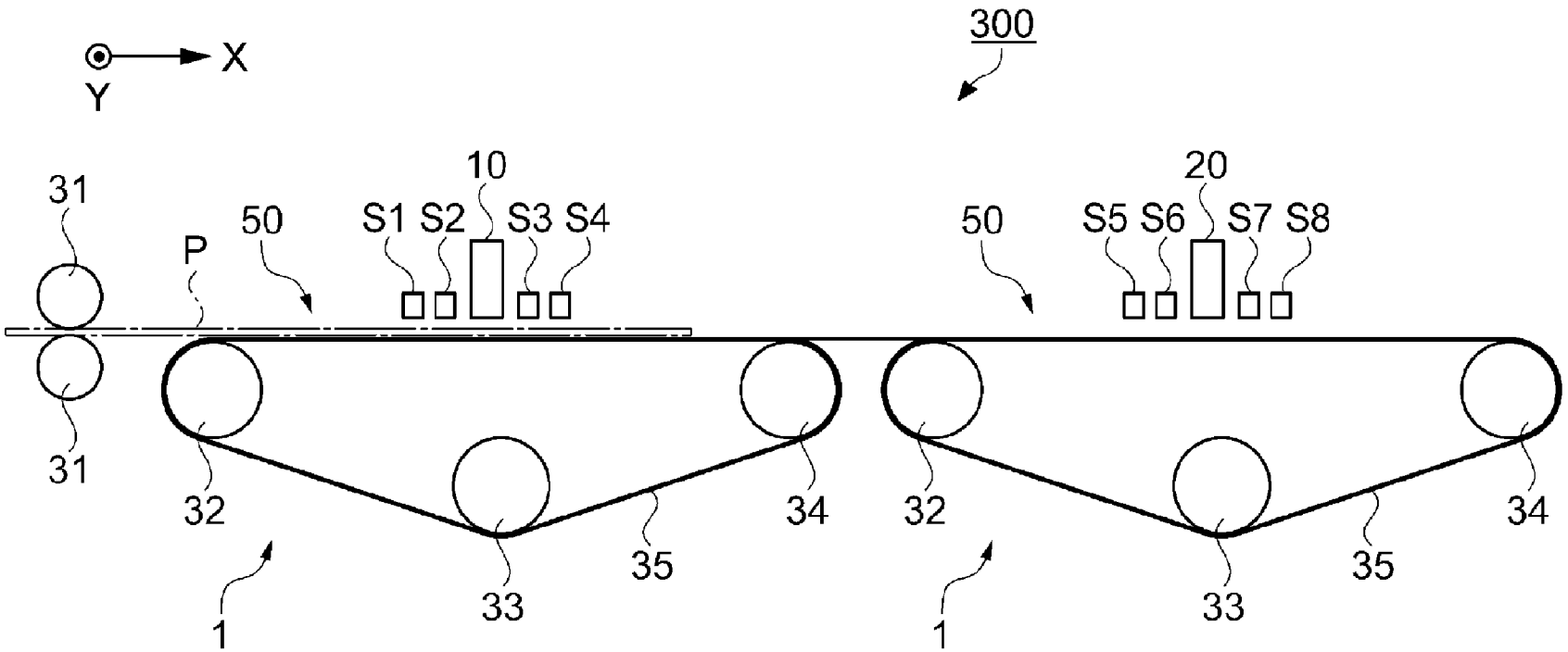
FIG. 11 is a side sectional view schematically illustrating the overall configuration of a tandem type ink jet printer.

In the above-described embodiments, one common transport mechanism 1 is provided for two head units, the head units 10 and 20, as shown in FIG. 1 and the like. However, the invention is not limited thereto. For example, FIG. 11 is a side sectional view schematically illustrating the overall configuration of an ink jet printer 300. The ink jet printer may have a tandem type configuration in which an independent transport mechanism 1 is provided for each of the head units 10 and 20.

The plurality of ejecting heads 11 is separated and arranged in the two head units 10 and 20. However, the invention is not limited thereto. For example, only one head unit may be disposed in the ink jet printer and all of the ejecting heads may be arranged in the head unit.

What is claimed is:

1. A print position correcting device comprising:

a head unit which ejects a liquid onto a print medium being transported on a transport surface;

detectors which detect a position of the print medium being transported;

a transport information calculator which calculates transport information regarding a transport status of the print medium based on the position of the detected print medium;

a movement speed calculator which calculates a movement speed used to move the head unit based on the transport information; and a controller which moves the head unit in a direction parallel to the transport surface based on the transport information and the movement speed.

2. The print position correcting device according to claim 1, wherein the transport information contains a position deviation degree that the print medium is deviated from a predetermined reference position in a width direction of the print medium, and wherein the controller moves the head unit based on the position deviation degree.

3. The print position correcting device according to claim 2, wherein the transport information contains a position deviation speed indicating the position deviation degree per unit time, and wherein the movement speed calculator calculates the movement speed used to move the head unit based on the position deviation speed.

4. The print position correcting device according to claim 1, wherein the transport information contains an incline degree that the print medium is inclined, and wherein the controller pivots the head unit on a shaft in a direction perpendicular to the transport surface based on the incline degree.

5. The print position correcting device according to claim 4, wherein the transport information contains an inclination speed indicating the incline degree per unit time, and wherein the movement speed calculator calculates the movement speed used to pivot the head unit on the shaft in the direction perpendicular to the transport surface based on the inclination speed.

6. The print position correcting device according to claim 1, wherein the detectors are disposed on the upstream side and the downstream side of the head unit in a transport direction of the print medium.

7. The print position correcting device according to claim 1, wherein the head unit includes a plurality of ejecting heads, wherein the movement speed calculator calculates the movement speed used to move each of the plurality of ejecting heads based on the transport information, and wherein the controller moves the plurality of ejecting heads in the direction parallel to the transport surface based on the transport information and the movement speed.

8. A printing apparatus comprising the print position correcting device according to claim 1 to perform printing on a print medium.

9. A method of controlling a print position correcting device, comprising:

detecting a position of a print medium being transported on a transport surface;

calculating transport information regarding a transport status of the print medium based on the position of the detected print medium;

calculating a movement speed used to move the head unit based on the transport information; and moving the head unit in a direction parallel to the transport surface based on the transport information and the movement speed.

* * * * *